US005978968A

United States Patent [19]

Lee

[11] Patent Number: 5,978,968

[45] Date of Patent: Nov. 9, 1999

[54] ATTACHMENT FOR HEADGEAR TO VENTILATE WHILE CLAMPING WEARER'S HEAD

[76] Inventor: Ben Gill-Ho Lee, 2136 Weatherly Pl., Fullerton, Calif. 92833

[21] Appl. No.: 09/123,058

[22] Filed: Jul. 27, 1998

Related U.S. Application Data

[63] Continuation-in-part of application No. 08/870,754, Jun. 9, 1997, abandoned.

[51] Int. Cl.[6] ..... A42B 1/22

[52] U.S. Cl. ..... 2/175.4; 2/182.2; 2/183; 2/195.2; 2/195.5; 2/DIG. 1

[58] Field of Search ..... 2/175.4, 195.5, 2/183, 195.2, DIG. 1, 182.1, 182.2

[56] References Cited

U.S. PATENT DOCUMENTS 361,833 4/1887 Newman ..... 2/175.4

2,418,764 4/1947 Ford ..... 2/195.5

*Primary Examiner*—Diana Oleksa

[57] ABSTRACT

An attachment 10 being made with a springy, yet relatively rigid material includes two elongated and U-shaped arms 12, 14 which are aligned with the front and rear portions of a lower periphery of an internal surface of a crown 22 of a headgear 20 respectively. The crown has an opening which is larger than its ordinary size for a wearer's head 30. Each arm has two end portions oriented toward the left and right portions of a lower periphery of the crown, spaced apart to each other in a distance shorter than a width between the left and right sides of the head, adapted to clamp the left and right sides of the head in the springy manner, also adapted to make the opening of the crown narrowed in its left and right directions while the opening is lengthened elliptically in its front and rear directions to provide air space to the head, whereby the air space can engage to ventilate scalp of the head keeping cool and dry and also to prevent hair of the head from being disturbed and pressed.

4 Claims, 3 Drawing Sheets

ATTACHMENT FOR HEADGEAR TO VENTILATE WHILE CLAMPING WEARER'S HEAD

BACKGROUND OF THE INVENTION

The present invention, which is a continuation-in-part of Ser. No. 08/870,754 filed Jun. 9, 1997, now abandoned, relates to an attachment for a headgear to provide air space to a wearer's head for ventilation, and more particularly to a springy, yet relatively rigid material of the attachment adapted to make an opening of a crown of the headgear narrowed in its left and right directions while the opening is lengthened elliptically in its front and rear directions to provide air space for ventilation.

For many years, the headgear of various style have been worn both for protection and as fashion apparel, and the wearers of the headgear have been suffered commonly from their inconveniences such as the wearer's hair being disturbed and pressed by the headgear and the wearer's scalp bearing the excessive heat and perspiration.

To date, numerous solution to these problems have been proposed but there remain a continually unsatisfied need for evermore efficient, cost effective, simple and shapely means for the headgear.

For examples, U.S. Pat. Nos. 660,062 923,986 1,187,507 1,434,743 1,434,745 1,566,891 2,129,798 2,818,574 2,832,077 3,289,212 3,495,272 4,101,981 4,274,157 4,951,320 5,054,122 5,101,516 5,226,180 5,365,607 and F. R. of Germany Pat. No. 884,067 each of which has the specific type of spacer elements attached to a sweat band of a headgear at the circularly spaced locations each other whereby the space between the spacers engage to ventilate the wearer's head.

For other examples, U.S. Pat. Nos. 221,313 275,670 1,140,812 1,530,870 2,117,764 2,127,797 2,383,396 2,451,140 3,780,382 4,131,953 5,090,054 and F. R. of Germany Pat. No. 3,110,593 each of which has the specific type of an element or elements attached to and spaced with the inner surface of a crown whereby the space between the crown and the elements engage to ventilate the wearer's head.

U.S. Pat. No. 215,998 issued to Waddell and Sample sets forth a ventilating hat including a circular frame being secured to the underside of a crown of the hat and three angular rests which are adjustably attached to the circular frame and of which the outer parts are curved inwardly and downwardly to provide air space from the hat for ventilation.

U.S. Pat. No. 3,089,145 issued to Kiefer sets forth a sun hat comprising a flat disc and the arcuated spring yoke which is secured at its center to the center of the disc and which terminates with open bifurcated ends adapted to hold the disc on the head at near the ears of the wearer so as to provide complete freedom to the scalp and the maximum of the ventilation.

U.S. Pat. No. 3,245,088 issued to Robison sets forth a sunbathing headgear comprising a conically configured hat and a pair of U-shaped rods of which ends detachably connected respectively to the holes provided in the hat, and which are apart in parallel relation each other to resiliently grip the opposite sides of the wearer's head.

SUMMARY OF THE INVENTION

Present invention is preferably embodied in an attachment made with a springy, yet relatively rigid material, including two elongated and U-shaped arms which are aligned with the front and rear portions of a lower periphery of a crown of a headgear respectively.

The crown has an opening which is larger than its ordinary size for a wearer's head.

Each arm has two ends oriented toward the left and right portions of the lower periphery of the crown respectively, spaced apart to each other in a distance shorter than a width between the left and right sides of the head, adapted to clamp the left and right sides of the head in the springy manner, and also adapted to make an opening of the crown narrowed in its left and right directions while the opening is lengthened elliptically in its front and rear directions so as to provide air space to the wearer's head.

Accordingly it is an object of the present invention to provide air space from the headgear to the wearer's head particularly along the front and rear sides of the head, whereby scalp of the wearer's head can be ventilated keeping dry and cool, the hair of the head can be stayed preventing from being disturbed and pressed, and the perspiration of the head can flow down preventing the headgear from being water stained and damaged.

Another object of the present invention is that the attachment can be detachably secured to the headgear by the simple movements of unfolding and refolding an inner band of the headgear so as to eliminate needs for any fastening means member.

Still another object of the present invention is that the attachment can be adapted to clamp the wearer's head at only the left and right sides thereof in order to hold the headgear in place on the head.

Still another object of the present invention is that the larger sized headgear can be utilized and therefore the fewer sizes of the headgear can be manufactured.

Still another object of the present invention is to make the headgear better shaped by narrowing the opening of the crown at its left and right sides and also by stretching the crown outwardly.

Still another object of the present invention is that the attachment is of simple construction, is readily and economically manufactured and yet is effective in accomplishing its intended purpose.

Other objects and further scope of the applicability of the present invention will become apparent from the detailed description given hereinafter. It should be understood, however, that the detailed description and specific examples, while indicating preferred embodiments of the invention, are given by way of illustration only since various changes and modifications within the spirit and scope of the invention will become apparent to those skilled in the art from the detailed description.

BRIEF DESCRIPTION OF THE DRAWING

The above and other features and objects of the present invention will be better understood from the following detailed description of the typical embodiments illustrated in the accompanying drawings, in which.

DESCRIPTION OF THE PREFERRED EMBODIMENTS

Figure 1:
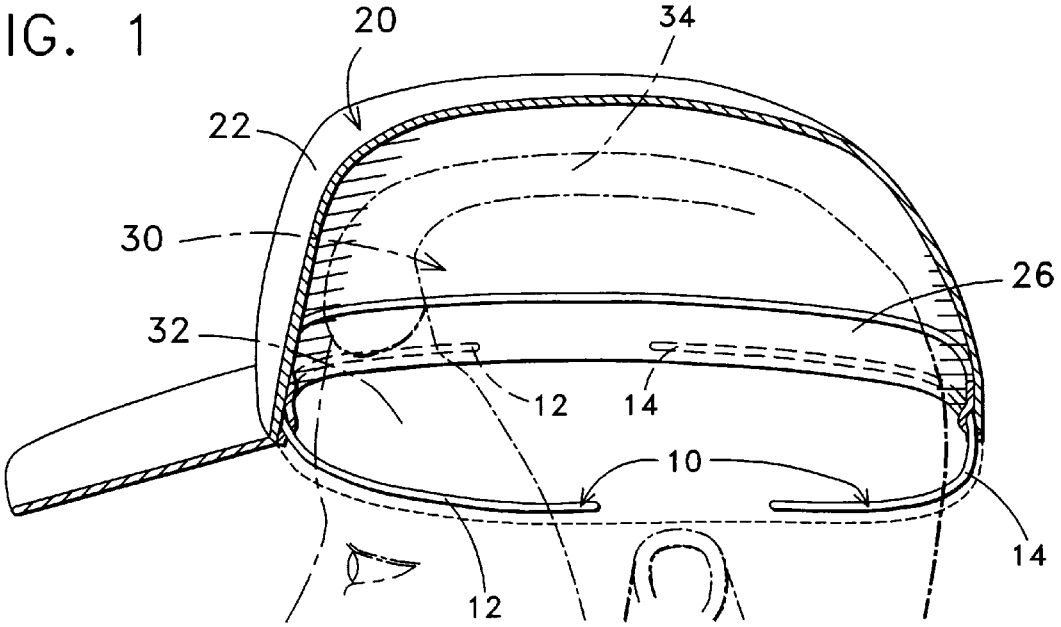
FIG. 1 illustrates a partially broken away perspective view of a headgear 20 in order to show an embodiment of an attachment 10 installed to the headgear and also to show a wearer's head 30 wearing the headgear in a typical fashion.

Now with more detailed reference to the drawings FIG. 1, the present invention, an attachment 10 for a headgear 20 to ventilate while clamping a wearer's head 30, which is a continuation-in-part of Ser. No. 08/870,754 filed Jun. 9, 1997, comprises two elongated and U-shaped arms 12, 14.

Each arm 12, 14 is formed or molded in one piece with a springy, yet relatively rigid material such as metal, plastic or the other synthetic.

The headgear 20 has a dome-shaped crown 22 which has an internal surface of which a lower periphery defining an opening to the interior cavity of the crown, and an inner band 26 which has a lower edge which is stitched together with the lower periphery of the internal surface of the crown so as to have a stitched line thereof.

The internal surface of the crown 22 has its left and right portions adapted to encompass the left and right sides of the wearer's head 30.

The arms 12, 14 are aligned with the front and rear portions of the lower periphery of the crown 22 respectively, the arms are located between the band 26 and the crown at immediately above their stitched line, and each arm has two ends oriented toward the left and right portions of the lower periphery of the crown respectively.

To install the attachment 10 into the headgear 20, first, the arms 12, 14 are inserted into the opening of the crown 22, and the arms are positioned toward the front and rear portions of the crown respectively.

Then, as the band 26 is unfolded downwardly, the arms 12, 14 are placed between the crown 22 and the band at immediately above their stitched line, and then the unfolded band is refolded back to its original position, so that the arms can be detachably secured to the headgear with no needs for any other fastening means member.

The ends of each arm 12, 14 are spaced apart to each other in a distance shorter than a width between the left and right sides of the wearer's head 30.

As the headgear 20 is putted on the wearer's head 30, the end portions of each arm 12, 14 are spread to each other in the left and right directions in the springy manner so as to clamp the left and right sides of the wearer's head in order to hold the headgear in place on the head.

The opening of the crown 22 of the headgear 20 is larger than its ordinary size for the wearer's head 30 so that fewer sizes of the headgear can fit to most people because a certain larger size of the headgear can fit with the wider range of sizes of the wearer's heads.

In accordance with an important aspect of the present invention, the arms 12, 14 which have a springy, yet relatively rigid characteristic are adapted to make the opening of the crown 22 narrowed in its left and right directions while the opening is lengthened in its front and rear directions, making the opening into an ellipse shape, so as to provide air space from the headgear 20 to the wearer's head 30 particularly along the front and rear sides of the head, whereby scalp 32 of the head can be ventilated through the air space to keep dry and cool, hair 34 of the head can be stayed within the air space to prevent from being disturbed and pressed, and the perspiration on the head can flow down through the space to prevent the headgear from being water stained and damaged.

Advantageously the attachment 10 is of simple construction, is readily and economically manufactured and yet is effective in accomplishing its intended purpose as described above.

Figure 2:
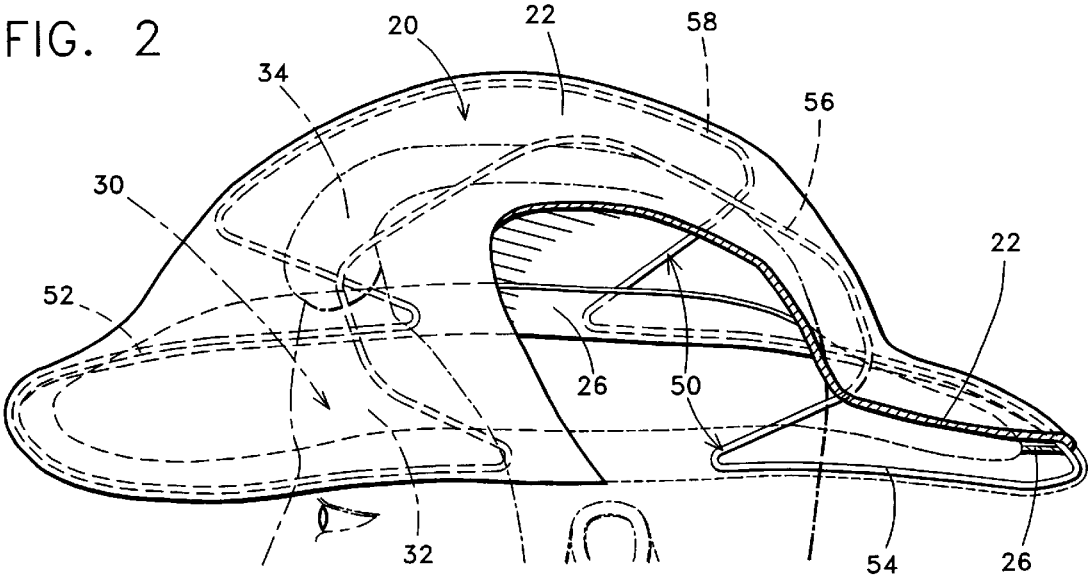
FIG. 2 illustrates a partially broken away perspective view of the headgear 20 in order to show an embodiment of an attachment 50 installed to the headgear and also to show a wearer's head 30 wearing the headgear in a typical fashion.
Figure 3:
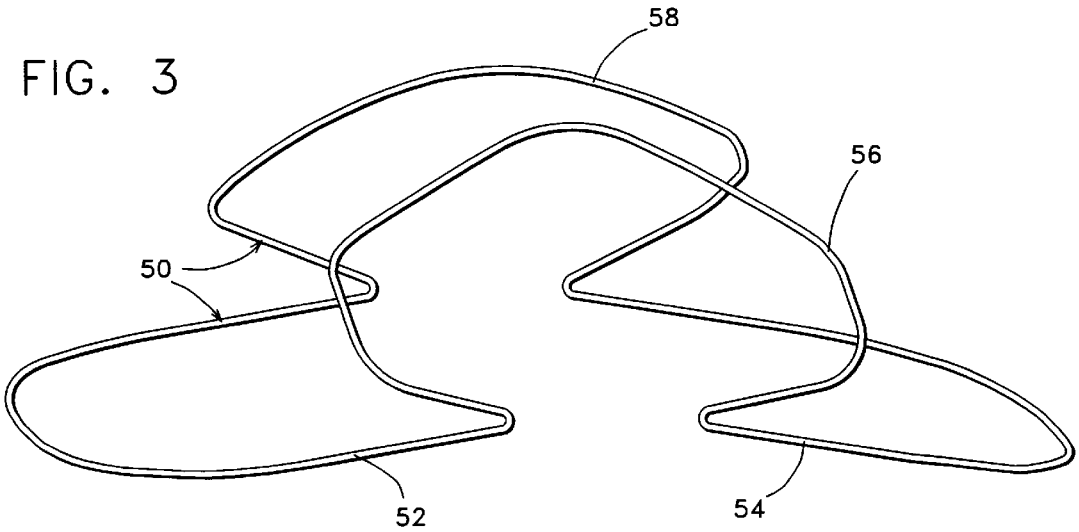
FIG. 3 illustrates a perspective view of the attachment 50.

An alternative attachment 50, as illustrated in FIGS. 2–3, comprises two elongated and U-shaped arms 52, 54 and two elongated and U-shaped stretchers 56, 58.

The arms 52, 54 are aligned with the front and rear portions of the lower periphery of the crown 22 respectively, the arms are located between the band 26 and the crown at immediately above their stitched line, and each arm has two ends oriented toward the left and right portions of the lower periphery of the crown respectively.

The stretchers 56, 58 are in contact with the left and right portions of the internal surface of the crown 22 respectively, each stretcher has two ends oriented toward the lower periphery of the crown.

The ends of each stretcher 56, 58 are fixedly connected to the corresponding ends of the arms 52, 54 respectively.

The ends of each arm 52, 54 are spaced apart to each other in a distance shorter than a width between the left and right sides of the wearer's head 30.

Figure 4:
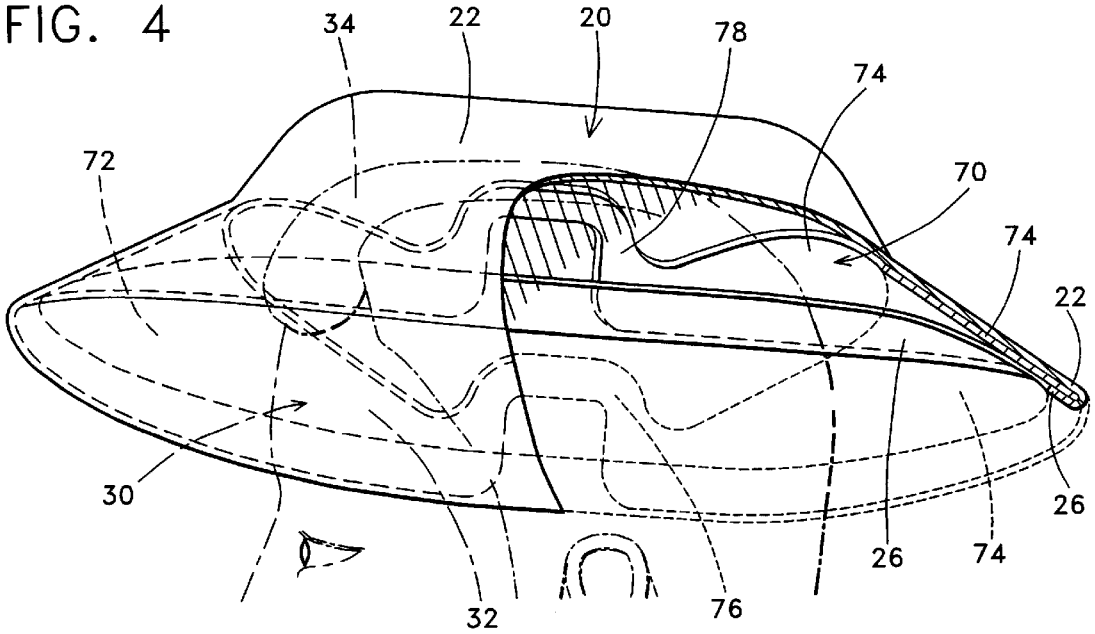
FIG. 4 illustrates a partially broken away perspective view of the headgear 20 and an alternative attachment 70 in order to show the attachment installed to the headgear and also show the wearer's head 30 wearing the headgear in a typical fashion.
Figure 5:
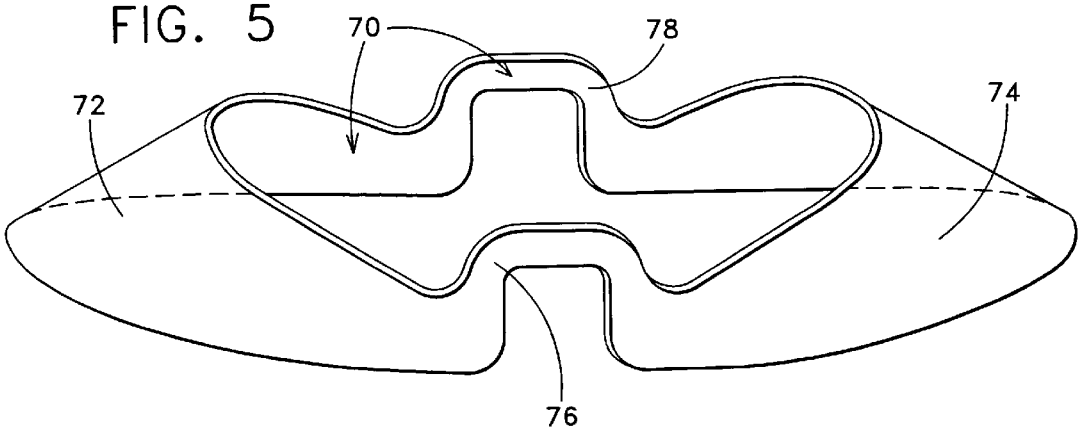
FIG. 5 illustrates a perspective view of the alternative attachment 70.

Another alternative attachment 70, as illustrated in FIGS. 4–5, comprises two elongated and U-shaped arms 72, 74 and two elongated and U-shaped stretchers 76, 78.

The arms 72, 74 are aligned with the front and rear portions of the lower periphery of the crown 22 respectively, the arms are located between the band 26 and the crown at immediately above their stitched line, and each arm has two ends oriented toward the left and right portions of the lower periphery of the crown respectively.

The stretchers 76, 78 are in contact with the left and right portions of the internal surface of the crown 22 respectively, each stretcher has two ends oriented toward the lower periphery of the crown.

The ends of each stretcher 76, 78 are fixedly connected to the corresponding ends of the arms 72, 74 respectively.

The ends of each arm 72, 74 are spaced apart to each other in a distance shorter than a width between the left and right sides of the wearer's head 30.

Each arm 72, 74 has its vertical cross-section which is relatively flat-shaped and inclined from the lower periphery of the crown 22 in the relatively upward and inward direction, the upper surface of each arm is in contact with the corresponding portions of the internal surface of the crown, and each end portion of each arm is narrower toward its end.

Each stretcher 76, 78 of the attachment 70 has its vertical cross-section which is relatively flat-shaped and oriented in the relatively up-right direction.

Each of the attachments 10, 50, 70 described here, utilizing the headgear 20 of which the crown 22 has the opening which is larger than its ordinary size for the wearer's head 30, has two arm members 12, 14, 52, 54, 72, 74 having the springy, yet relatively rigid characteristic adapted to make the opening of the crown narrowed in its left and right direction while the opening is lengthened in its front and rear direction, making the opening into an ellipse shape, so as to provide air space from the headgear to the wearer's head, particularly along the front and rear sides of the wearer's head, for air circulation to the wearer's head.

As is apparent from the foregoing specification, the invention is susceptible of being embodied with various alterations and modifications which may differ particularly from those that have described in the preceding specification and description recognizing various modification been apparent the scope herein shall be deemed as defined in the claims set forth hereinafter.

What is claimed:

1. An attachment in combination with a headgear comprising:

said headgear comprising:

a dome-shaped crown which is adapted to engage and to cover a wearer's head, said crown having an internal surface having a lower periphery defining an opening to an interior cavity of said crown, said opening being larger than an ordinary size wearer's head, said internal surface having left and right portions adapted to encompass the left and right sides of a wearer's head respectively, an inner band having a lower edge stitched together with said lower periphery of said internal surface of said crown so as to form a stitched line;

said attachment comprising:

two elongated and U-shaped arms made with a springy, yet relatively rigid material, aligned with front and rear portions of said lower periphery of said crown respectively, located between said band and said crown immediately above said stitched line, each said arm having two ends oriented toward left and right portions of said lower periphery of said crown respectively, the ends of each said arm being adapted to be spaced apart from each other a distance shorter than a width between the left and right sides of a wearer's head;

whereby said arms are adapted to clamp the left and right sides of a wearer's head in a springy manner in order to hold said headgear in place on a head, and said arms are also adapted to make said opening of said crown narrowed in its left and right directions while said opening is lengthened in its front and rear directions, making said opening into an ellipse shape, so as to provide air space between said headgear and the front and rear sides of a head, so that the scalp of a head can be ventilated through said air space to keep dry and cool, the hair of a head can be stayed within said air space to prevent the hair from being disturbed and pressed, and perspiration on a head can flow down through said air space to prevent said headgear from being water stained and damaged.

2. An attachment in combination with a headgear of claim 1, wherein each said arm has a vertical cross-section being relatively flat-shaped and inclined from said lower periphery of said crown in a relatively upward and inward direction so that an upper surface of said arms are in contact with corresponding portions of said internal surface of said crown, each said arm narrowing toward each of its ends.

3. An attachment in combination with a headgear of claim 2, wherein said attachment further includes two elongated and U-shaped stretchers being in contact with the left and right portions of said internal surface of said crown respectively, each said stretcher having two ends oriented toward said lower periphery of said crown, the ends of said stretchers being fixedly connected to corresponding ends of said arms.

4. An attachment in combination with a headgear of claim 3, wherein the cross-section of each said stretcher is relatively flat-shaped and oriented in a relatively up-right direction.

* * * * *